US005752314A

United States Patent [19]

Poquette et al.

[11] Patent Number: 5,752,314

[45] Date of Patent: May 19, 1998

[54] TRAVELER APPLICATION SYSTEM

[75] Inventors: Gereon E. Poquette, Denver; Rio H. Benson, Gastonia, both of N.C.

[73] Assignee: Carter Traveler Company, Gastonia, N.C.

[21] Appl. No.: 678,351

[22] Filed: Jul. 11, 1996

[51] Int. Cl.[6] ..... B23P 19/04

[52] U.S. Cl. ..... 29/765; 29/811.2

[58] Field of Search ..... 29/229, 765, 809, 29/811.2, 816

[56] References Cited

U.S. PATENT DOCUMENTS

| | | | |
|---|---|---|---|
| 1,073,280 | 9/1913 | Owen | 29/765 |
| 1,109,309 | 9/1914 | Staubli | 29/765 |
| 1,110,690 | 9/1914 | Hurt | 29/765 |
| 1,110,691 | 9/1914 | Hurt | 29/765 |
| 1,189,448 | 7/1916 | Hevey | 29/765 |
| 2,094,517 | 9/1937 | Andreoli | 29/765 |
| 2,222,125 | 11/1940 | Stehlik . | |
| 2,418,209 | 4/1947 | Watts | 29/765 |
| 2,749,601 | 6/1956 | Rouillon . | |
| 2,856,676 | 10/1958 | Furst | 29/765 |
| 2,931,038 | 4/1960 | Wandel . | |
| 2,953,845 | 9/1960 | Ramseier . | |
| 3,054,248 | 9/1962 | Austel | 29/765 X |
| 3,098,344 | 7/1963 | Ramseier et al. | 29/765 X |
| 3,100,334 | 8/1963 | Ramseier | 29/765 |
| 3,191,284 | 6/1965 | Eurey | 29/765 X |
| 3,263,317 | 8/1966 | Iwamatsu | 29/765 X |
| 3,353,736 | 11/1967 | Bauer . | |
| 3,490,127 | 1/1970 | Anderson | 29/765 |
| 3,574,255 | 4/1971 | Mortimer | 29/765 |
| 4,149,297 | 4/1979 | Monacelli . | |
| 4,160,317 | 7/1979 | Sergeant | 29/816 X |
| 4,575,933 | 3/1986 | Neff . | |
| 4,864,750 | 9/1989 | Uyemura | 29/765 |
| 5,303,464 | 4/1994 | Neff | 29/765 |

FOREIGN PATENT DOCUMENTS

| | | | |
|---|---|---|---|
| 1028919 | 4/1958 | Germany | 29/765 |
| 1067346 | 10/1959 | Germany | 29/765 |
| 1104405 | 4/1961 | Germany | 29/765 |

*Primary Examiner*—Daniel Moon

*Attorney, Agent, or Firm*—Leatherwood Walker Todd & Mann, P.C.

[57] ABSTRACT

A method and apparatus for applying travelers to a ring of a fiber processing machine. A traveler applicator includes a traveler rail on which travelers are urged by a pusher towards a reciprocating traveler tooth. Actuation of a trigger causes the traveler tooth to engage a traveler from the traveler rail and to advance it outwardly for attachment to a ring. Release of the trigger causes the tooth to retract and allows clearance between the tooth and the next traveler positioned on the traveler rail for dispensing. Upon full retraction of the tooth, the tooth advances inwardly to engage the next traveler on the traveler rail. A spring-biased engagement member contacts the traveler to secure it on the tooth. A cartridge having a plurality of traveler-holding rails about its periphery feeds travelers to the traveler rail. Once a cartridge rail is depleted of travelers, the cartridge is rotated such that the next rail having travelers is presented to the traveler rail for dispensing.

40 Claims, 10 Drawing Sheets

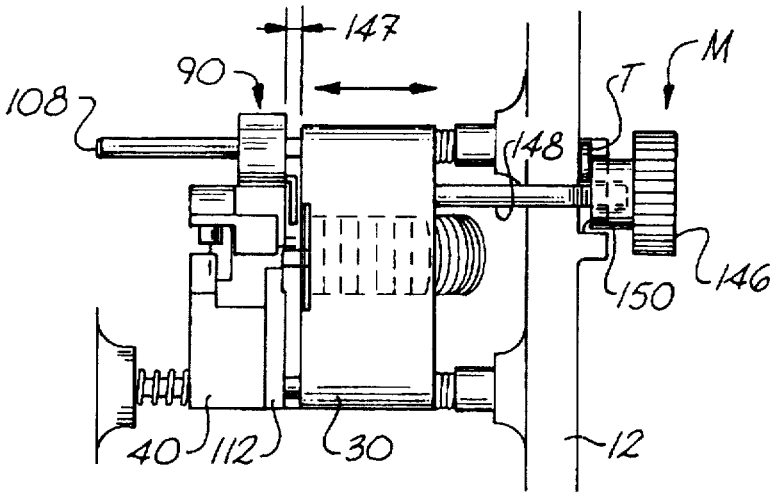
Fig. 13
Fig. 14A
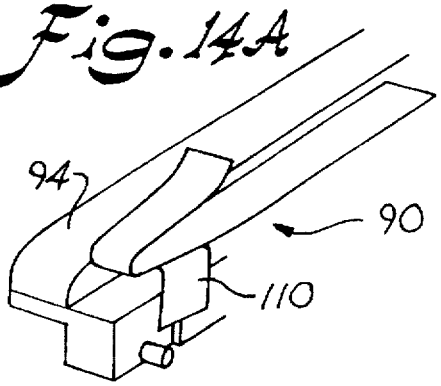
Fig. 14B
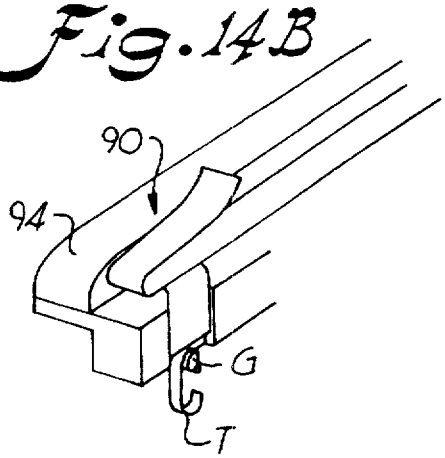
Fig. 14C
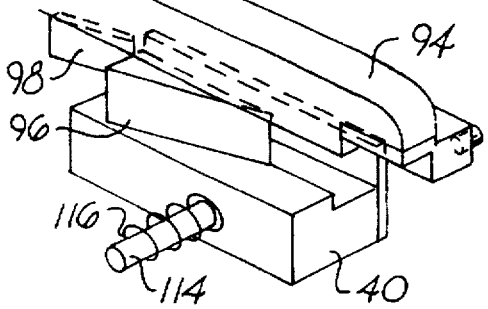
Fig. 14D
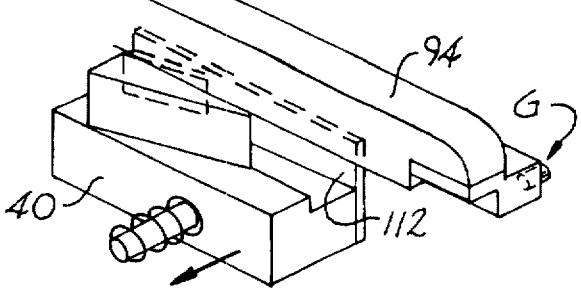

TRAVELER APPLICATION SYSTEM

BACKGROUND OF THE INVENTION

This invention relates generally to a device and method of applying travelers to rings of ring spinning machines and twisting machines.

Travelers are commonly used on rings found in ring spinning machines and twisting machines. A typical traveler design includes a C-shaped metal clip which attaches to the ring for sliding movement around the ring. Bands of fibers having little twist, known as roving, or no twist, known as sliver, pass through the drafting zones of a spinning machine and twist is placed in the fibers after they depart the final drafting zone.

Yarn is formed by twisting fibers exiting the drafting system with the combined rotation of the bobbin and traveler.

The traveler rotates on the ring and serves as (1) a guide for yarn to the bobbin; and (2) a brake to control yarn tension.

Because the traveler and the rings on which the travelers ride are typically metal, the metal interface between the traveler and ring causes wear, primarily in the travelers. After a period of time, when the travelers become too worn, they must be replaced.

Replacement of travelers on the rings is generally performed by hand. Because of the relatively small size and light weight of the individual travelers, applying the travelers one by one to individual rings can be a time-consuming and tedious endeavor. In an attempt to expedite this procedure, several devices have been patented for dispensing travelers.

For example, U.S. Pat. No. 2,749,601, issued to Rouillon, discloses a pistol-shaped device into which a magazine of travelers is fed laterally. A tongue is used to advance an individual traveler from the magazine outwardly towards a spinning ring. Ultimately, through interaction with a feed head provided on the device, the traveler is placed onto the ring. U.S. Pat. No. 2,953,845, issued Ramseier, also discloses a device where travelers are fed in laterally. The travelers move along a guide rod, and adjustment means are provided for travelers of different sizes, through use of an eccentric pin. Further, U.S. Pat. No. 4,575,933 issued to Neff, discloses a device where ring travelers are supplied on a flexible magazine strip and are transferred to a magazine bar by pulling at the magazine strip in a pre-determined location. The magazine bar is bent off at one end and is tapered in order to form a hook for temporarily holding a traveler prior to placement on a ring.

Other devices have also been patented for dispensing small items, such as U.S. Pat. Nos. 2,222,125, issued to Stehlik, and 3,353,736, issued to Bauer, which each disclose devices having cartridges with holding cells that are individually exhausted in succession. The Bauer device carries drapery hooks, and the Stehlik device carries nails. U.S. Pat. No. 2,931,038, issued to Wandel, discloses cartridges of staples wherein layers of staples are used in succession.

While the foregoing designs are known, there still exists a need for quick and easy-to-use system for inserting a supply of travelers into an applicator and for applying the travelers to the ring of a textile fiber processing machine.

SUMMARY OF THE INVENTION

It is, therefore, the principal object of this invention to provide a traveler application system which provides for easy loading of travelers into a traveler applicator and expedited placement of travelers onto spinning and twisting rings.

It is another object of this invention to provide a cartridge loaded with travelers which can be inserted into a traveler applicator.

It is yet another object of the present invention to provide an expendable cartridge carrying multiple rows of travelers for use in a traveler application device.

Yet another object of the present invention is to provide a method of replenishing travelers in a traveler applicator.

A still further object of the present invention is to provide a method of dispensing a traveler and attaching the traveler on a ring.

Generally, the present invention includes a device for applying a traveler to a ring of a textile ring spinning machine, the device includes a body member having a first end and a second end opposite the first end. The body member defines a traveler receiving compartment, open to the first and second ends of the body member.

A cartridge member is carried in the traveler receiving compartment, and the cartridge member defines a longitudinal axis, and is rotatable about the longitudinal axis within the traveler receiving compartment. The cartridge member has plurality of cartridge rails, each of the cartridge rails being adapted for carrying a plurality of travelers thereon.

A transport rail is provided having a first end next to one of the cartridge rails and a second end next to the second end of the body member. A spring-biased pusher is carried next to one of the cartridge rails for urging a traveler from the cartridge rail towards the second end of the transport rail. A tooth is provided which is movable between a retracted position and an extended position, and between a clearance position and an engagement position. The tooth is adapted to engage a traveler on the second end of the transport rail when in the retracted and engagement positions, and for placement of a traveler on a ring of a ring-spinning machine when in the extended position.

An indexing mechanism may also be provided for indexing the cartridge within the traveler applicator to sequentially present each of the cartridge rails of travelers to the transport rail one rail at a time.

The present invention also includes a method of applying travelers to a ring of a textile processing machine with the present traveler applicator device, including providing a traveler applicator having a transport rail for carrying a plurality of travelers and providing a cartridge adjacent to the transport rail, wherein the cartridge has a plurality of rails each carrying a plurality of travelers. Then, a traveler from at least one of the cartridge rails is transferred to the transport rail. The traveler transferred to the transport rail from the cartridge is then pushed to the end of the transport rail, and a moveable tooth is provided for engaging the traveler at the end of the transport rail. The traveler is removed from the end of the transport rail with the moveable tooth, and the traveler is moved outwardly from the transport rail with the moveable tooth. Finally, the traveler is applied from the moveable tooth onto the ring of the fiber processing machine.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which:

FIG. 13 is a partial frontal view of a traveler applicator device constructed in accordance with the present invention, illustrating the adjustment mechanism for adjusting the clearance between a traveler tooth, blocking assembly, and a traveler receiver;

FIG. 14A is a partial perspective view of a transfer assembly for use in connection with a traveler applicator device constructed in accordance with the present invention;

FIG. 14B is a partial perspective view of the transfer assembly shown in FIG. 14A, illustrating a traveler being carried on a traveler tooth;

FIG. 14C is a partial perspective view of a transfer assembly for use in connection with a traveler applicator device constructed in accordance with the present invention, illustrating a traveler block assembly in an engagement position;

FIG. 14D is a partial perspective view of the transfer assembly shown in FIG. 14C, illustrating the traveler block assembly in an intermediate position;

DESCRIPTION OF THE PREFERRED EMBODIMENT

The accompanying drawings and the description which follows set forth this invention in its preferred embodiment. However, it is contemplated that persons generally familiar with travelers and ring spinning will be able to apply the novel characteristics of the structures illustrated and described herein in other contexts by modification of certain details. Accordingly, the drawings and description are not to be taken as restrictive on the scope of this invention, but are to be understood as broad and general teachings.

Figure 1:
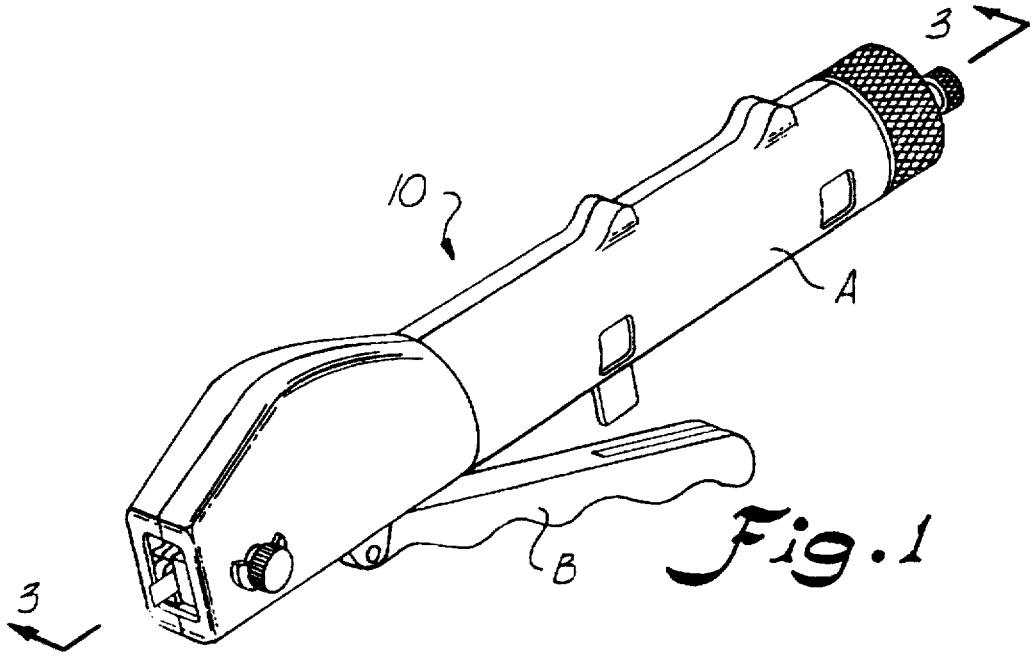
FIG. 1 is a perspective view of a traveler applicator device constructed in accordance with the present invention.

Referring now to the drawings, wherein like reference characters represent like elements or features throughout the various views, the traveler application system of the present invention is indicated generally in the figures by reference character 10. To provide an overview, traveler applicator 10 is illustrated in FIG. 1 having an elongated body, or handle, member, generally A, which lends itself to being carried in the hand of a user (not shown). Extending outwardly from body member B is a moveable trigger B. Briefly, trigger B is used to advance a traveler T outwardly from handle member A for ultimately applying the traveler T to a ring R, shown in FIG. 9.

Figure 2A:
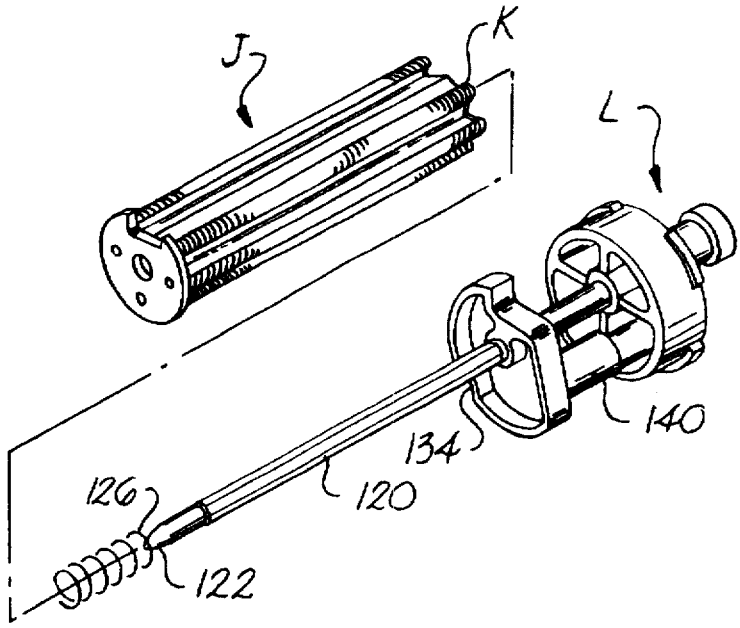
FIG. 2A is an exploded view of a traveler cartridge and loading assembly for use in connection with a traveler applicator device constructed in accordance with the present invention.
Figure 2:
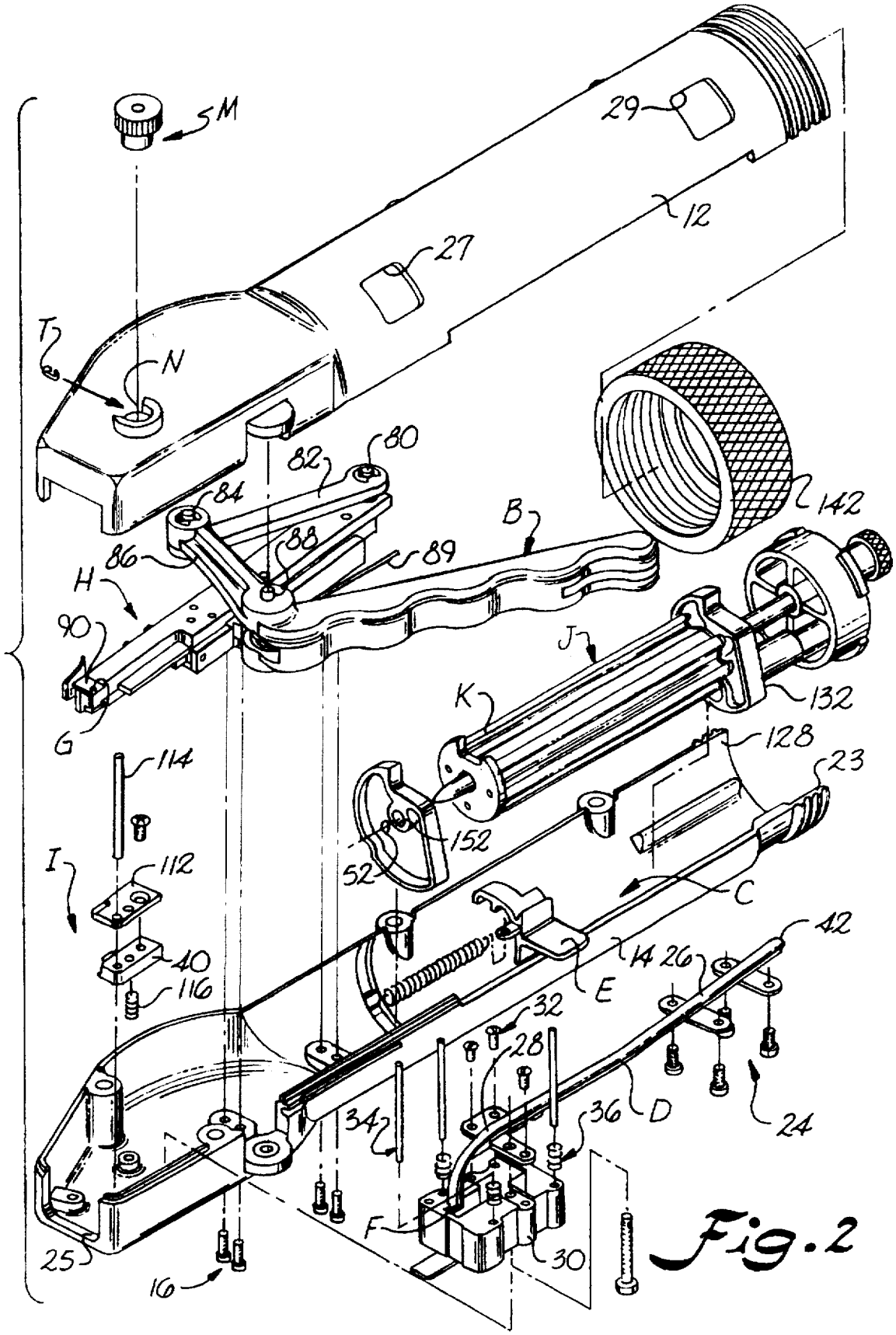
FIG. 2 is an exploded view of a traveler applicator device constructed in accordance with the present invention.
Figure 3:
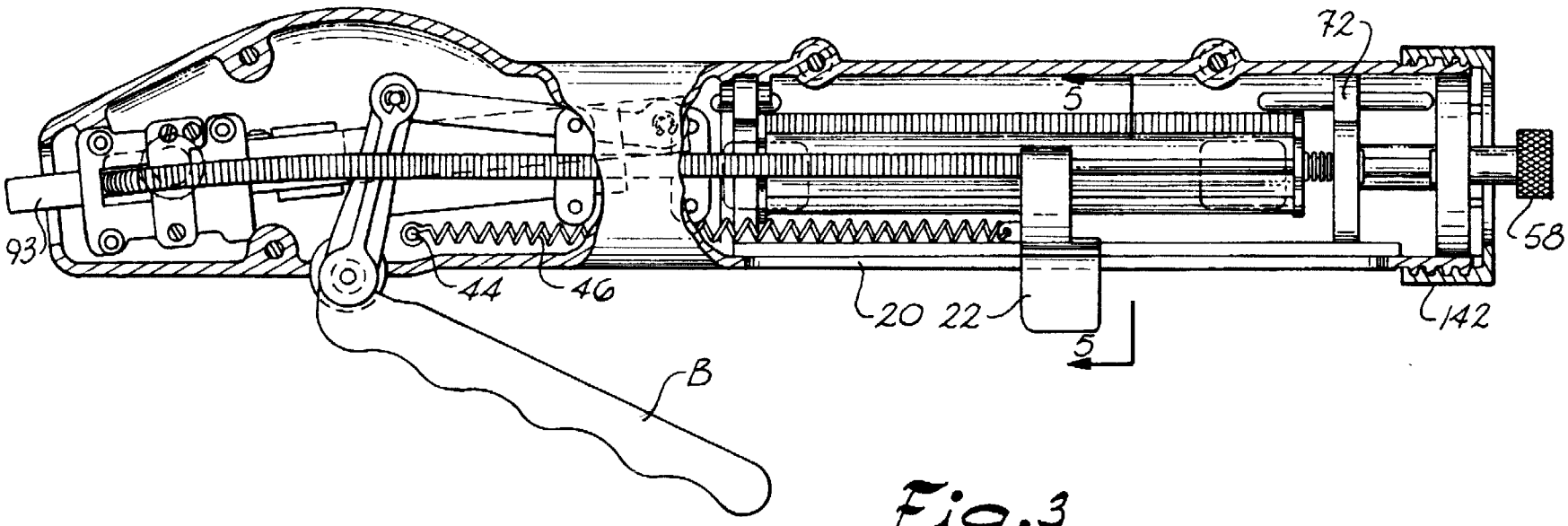
FIG. 3 is a sectional view taken along lines 3—3 of FIG. 1.
Figure 8:
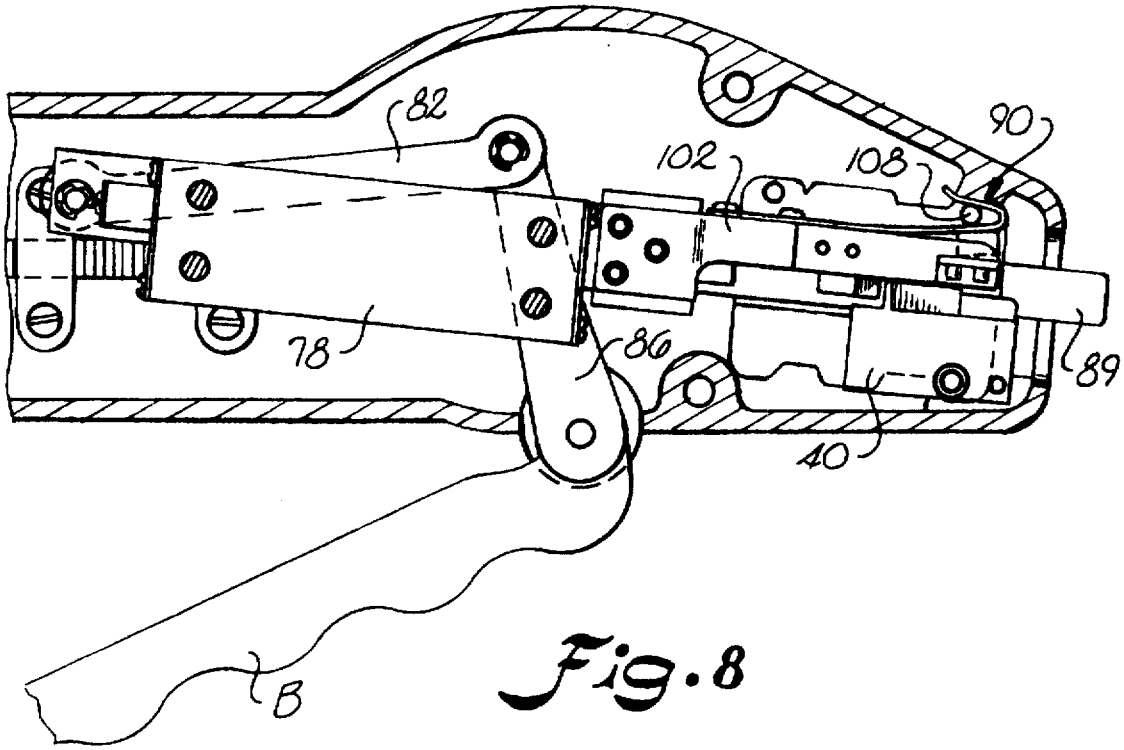
FIG. 8 is a partial sectional view of a traveler applicator device constructed in accordance with the present invention, wherein a traveler carrier tooth is illustrated in a retracted position.
Figure 9:
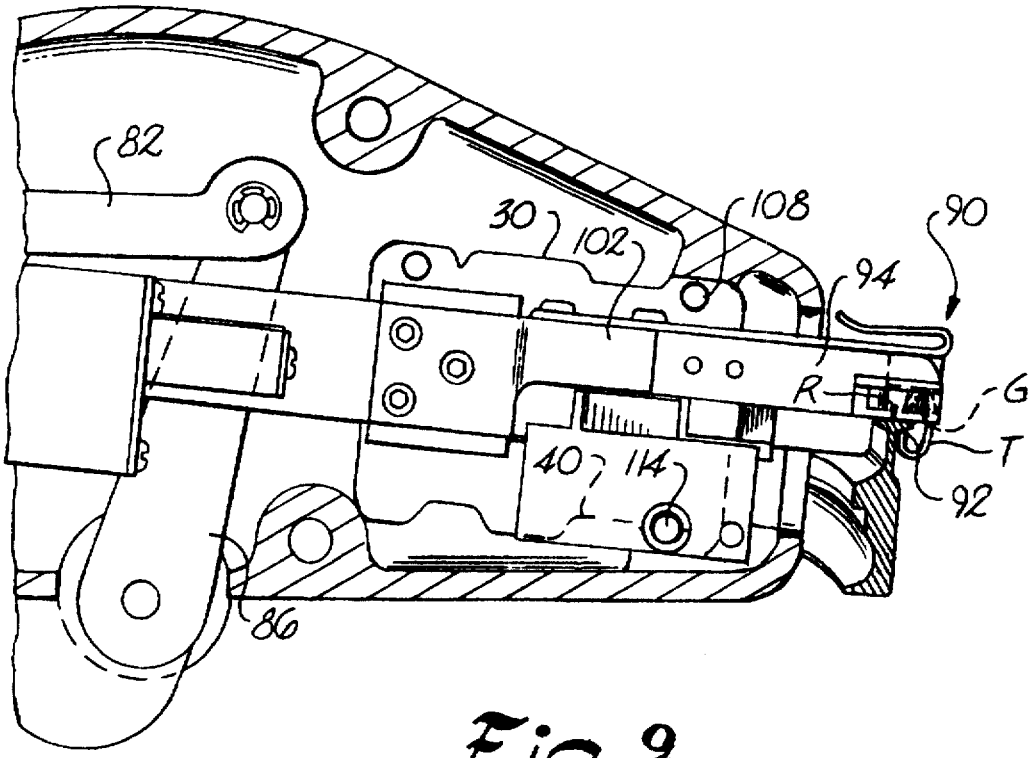
FIG. 9 is a partial sectional view of a traveler applicator device constructed in accordance with the present invention, illustrating the traveler tooth in an extended position.
Figure 14E:
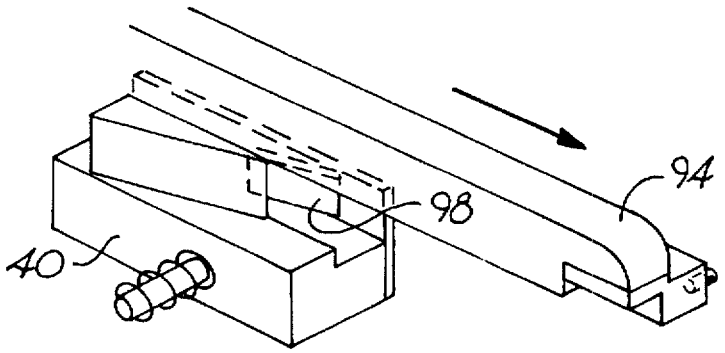
FIG. 14E is a partial perspective view of the transfer assembly shown in FIG. 14C, illustrating the transfer assembly in a near-extended position.

Handle member A defines a traveler receiving compartment, generally C therein, as can be seen in FIGS. 2 through 4C. A transport rail D is carried within traveler receiving compartment C and allows travelers T to be slidingly carried thereon in a side-by-side relationship. A spring-biased pusher E is also carried by body member B, and as illustrated in FIG. 3, urges travelers along transport rail D towards the terminus F of transport rail D. At terminus F, a tooth G carried by a transfer assembly H picks up a traveler T, and through squeezing of trigger B, transfer assembly H carries the traveler T outwardly for attachment to a ring R, as illustrated in FIGS. 8 and 9, and FIG. 14B.

Transfer assembly H moves outwardly upon squeezing of trigger B, and reciprocates inwardly upon release of trigger B. While transfer assembly H reciprocates, a transfer block assembly I blocks the next traveler T at terminus F from further movement, until tooth G is retracted back into position for engaging that next traveler T and advanced outwardly.

A cartridge J is provided within traveler receiving compartment C for carrying a supply of travelers T. The travelers T are carried in a side-by-side relationship on individual cartridge rails K spaced about the periphery of cartridge J. Pusher E engages the rearwardmost traveler T on a particular cartridge rail K and, upon alignment of that cartridge rail K with transfer rail D, pushes that traveler, and all the travelers between it and terminus F towards terminus F. Once all of the travelers T have been exhausted from that particular cartridge rail, a cartridge indexing mechanism L is actuated to rotate cartridge J such that a cartridge rail K having travelers T thereon is brought into alignment with transfer rail D, for allowing continued traveler T dispensing.

An adjustment mechanism M is also provided, as illustrated in FIGS. 2 and 13, wherein a traveler T is inserted within a recess N for allowing proper adjustment of traveler applicator 10 for travelers T of different sizes.

In a preferred embodiment, traveler applicator 10 includes handle member A, being constructed of two halves, generally 12, 14, which are attached to one another with generally 16, or other similar fasteners. Although body member A is illustrated as being comprised of two halves 12, 14, it is to be understood that it could be constructed of more pieces, or it could be of unitary construction, if desired.

Figure 10:
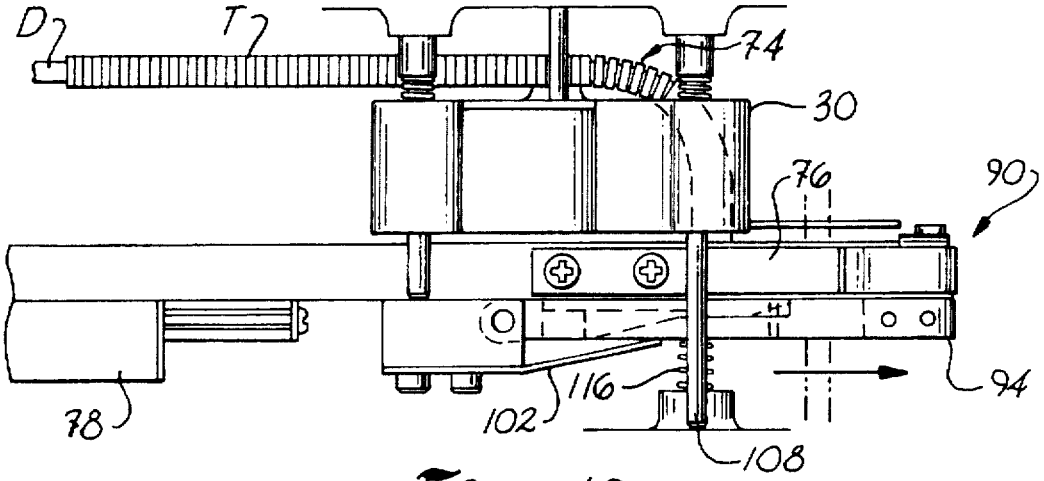
FIG. 10 is a partial plan view of a traveler applicator device constructed in accordance with the present invention, illustrating a traveler transport mechanism in an extended position.
Figure 12:
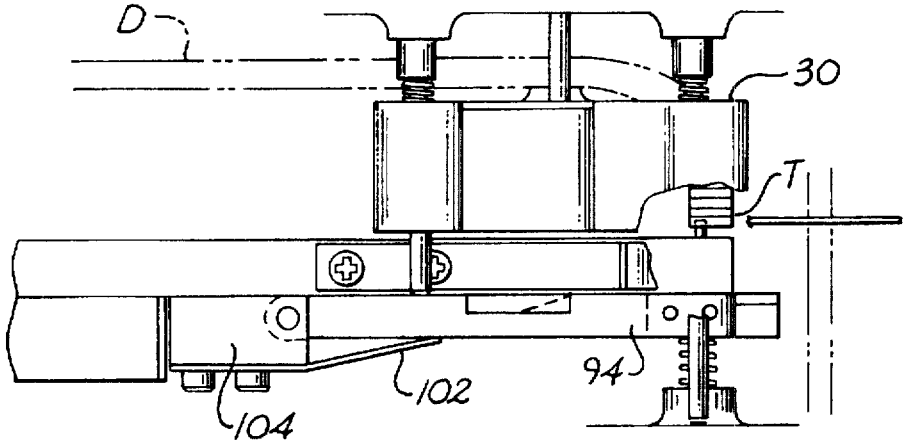
FIG. 12 is a partial plan view of a traveler applicator device constructed in accordance with the present invention, illustrating a traveler tooth in an engagement position.

Pivotally connected to handle member A is trigger B. Handle number A is sized such that a user would be able to hold traveler applicator 10 in the palm of his or her hand and to actuate trigger B with the fingers of the same hand. Preferably, the handle A extends downwardly at an angle between 5 and 10 degrees from horizontal, and preferably, at approximately 6 degrees during use to aid in the comfort to the user during operation. Trigger B actuates transfer assembly H and serves to reciprocate transfer assembly H to and fro between an extended position, as illustrated in FIGS. 9 and 10, and a retracted position, as illustrated in FIG. 8 and 12. Since tooth G is provided on an end of transfer assembly H, tooth G likewise moves between retracted and extended positions, as illustrated in FIGS. 8 and 9, respectively. Trigger B may include a slot 20 for receipt of finger 22 of pusher E, which extends outwardly from handle member A, when trigger B is depressed. Together, halves 12, 14 define traveler receiving compartment C. Compartment C extends from a first open end 23 to a second open end 25 opposite first end 23. Ends 23, 25 correspond to the ends of body member A. Body member A defines access windows 27, 29 for allowing a user to peer into compartment C and to potentially make adjustment through such windows 27, 29 for items carried therein.

Transport rail D is attached inside compartment C and extends longitudinally therein. Fasteners, generally 24, such as screws are used to connect one end 26 of transport rail D to handle portion 14, and the second end 28 of transport rail D is attached to a receiver block 30 by fasteners, generally 32, such as screws. Receiver block 30 is spring-mounted to lo handle portion 14 through the use of pins, generally 34, which pass through coil springs, generally 36, interposed between one face of receiver block 30 and an interior portion of handle portion 14. The spring-mounting of receiver 30 works in conjunction with cartridge indexing mechanism L to allow for adjustment of traveler block 40 with respect to transfer assembly H and traveler block assembly I. This adjustment feature allows for applicator 10 to be used for dispensing various sizes of travelers T.

Transport rail D is of a cross-sectional profile to allow the generally C-shaped travelers T to slide therealong while being retained on a rail D. The cross-sectional profile of transport rail D is similar to that of the cross-sectional profile of a cartridge rail K. Travelers are supplied from cartridge J to free end 42 of transport rail D and are pushed therealong in a stacked, side-by-side relationship, by pusher E.

Pusher E is illustrated in FIGS. 2, 3, and 4A through 4C. Pusher E is connected to a post 44 of handle portion 14 via a coil spring 46. Pusher E is moveable along cartridge J, through interaction of finger 22 in a slot 20 defined at intersection of handle portions 12 and 14.

FIG. 3 illustrates pusher E at approximately midway along the slot 20. As can be seen from that figure, pusher E bears against the rightmost extreme traveler T on the particular rail K of cartridge J. The spring force of pusher E against that traveler, forces all the travelers to the left of that traveler to be urged towards terminus F of transport rail D.

Figure 4A:
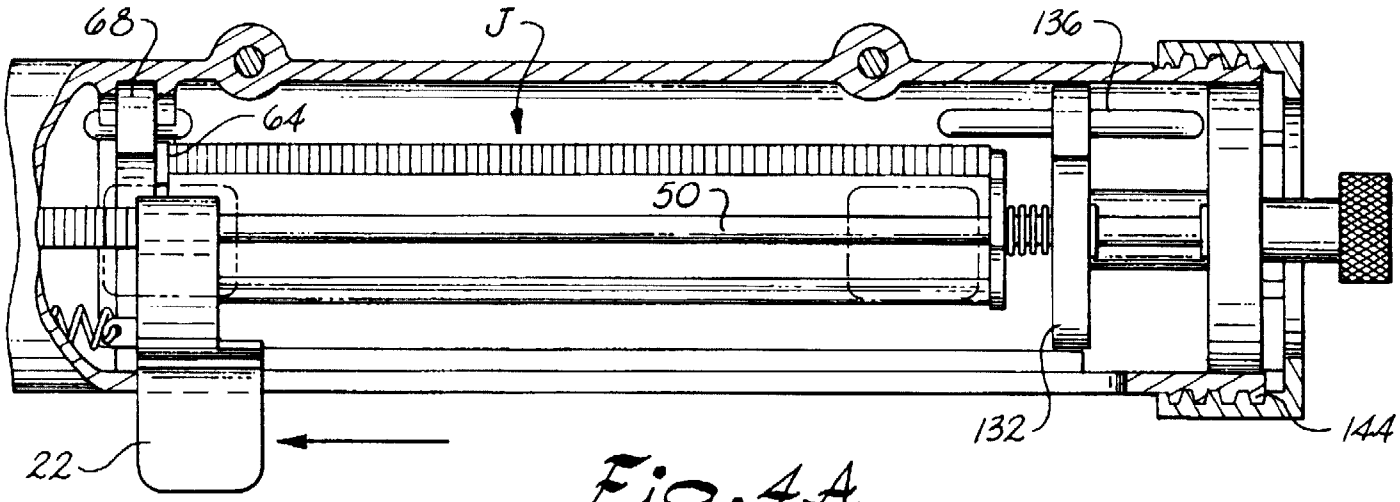
FIG. 4A is a partial sectional view of a traveler applicator devise constructed in accordance with the present invention, illustrating a traveler pusher at a forward position.

FIG. 4A illustrates pusher E at approximately the leftmost extent of its travel within slot 20, which occurs when a particular rail K, in this instance rail 50, is depleted of travelers. Cartridge J is indexed by rotating it about its longitudinal axis 52 through use of a cartridge index mechanism L. In so doing pusher E is moved to the rightmost extent within slot 20 such that the profiled head 54 of pusher E, which corresponds to the cross-sectional shape of rails K, clears the rightmost end 56 of cartridge D. This allow cartridge D to be rotated with knob 58 such that a new, traveler-loaded rail, 60, is in alignment with free end 42 transport rail D. A cartridge washer 62 is provided at the leftmost end 64 of cartridge J and defines a slot 66 therein. Washer 62 remains stationary as cartridge J turns such that slot 62 remains in communication with free end 66 of transport rail D. Washer 62 serves to prevent travelers from other rails K from falling into the interface between the end of cartridge J and diaphragm member 68, which generally divides compartment C into a traveler rail section to the left of member 68 and a cartridge section to the right. Once cartridge J has been rotated to the position as shown in FIG. 4B, pusher E is moveable to contact the rightmost traveler on that rail 70, as seen in FIG. 4C.

Figure 4B:
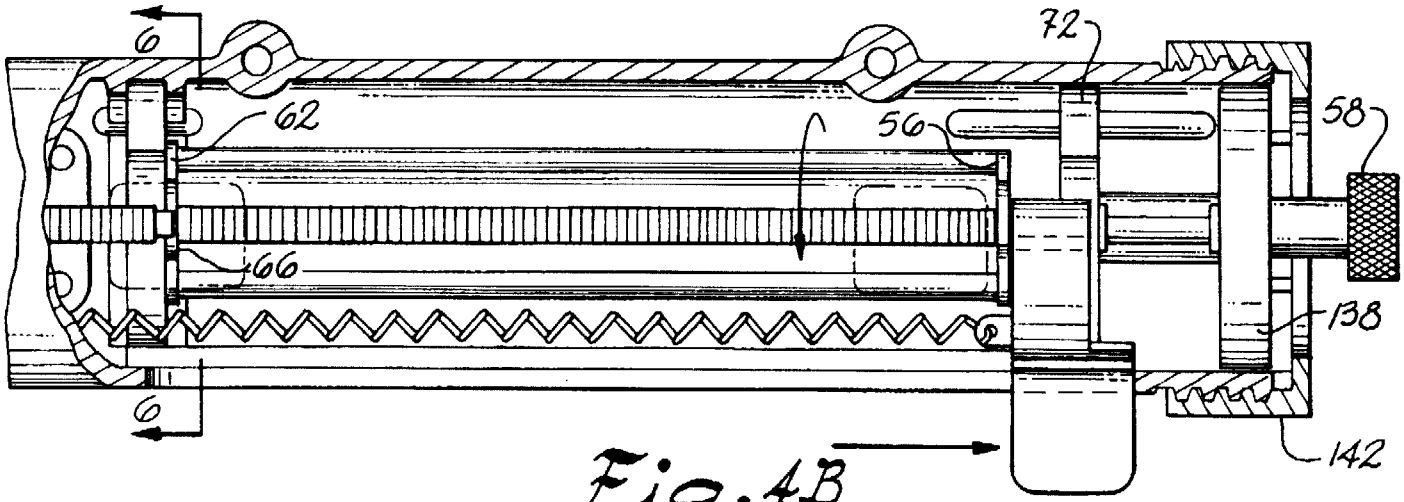
FIG. 4B is a partial sectional view of a traveler applicator device constructed in accordance with the present invention, illustrating a traveler pusher in a rearward position.
Figures 4C, 5, 6, 7:
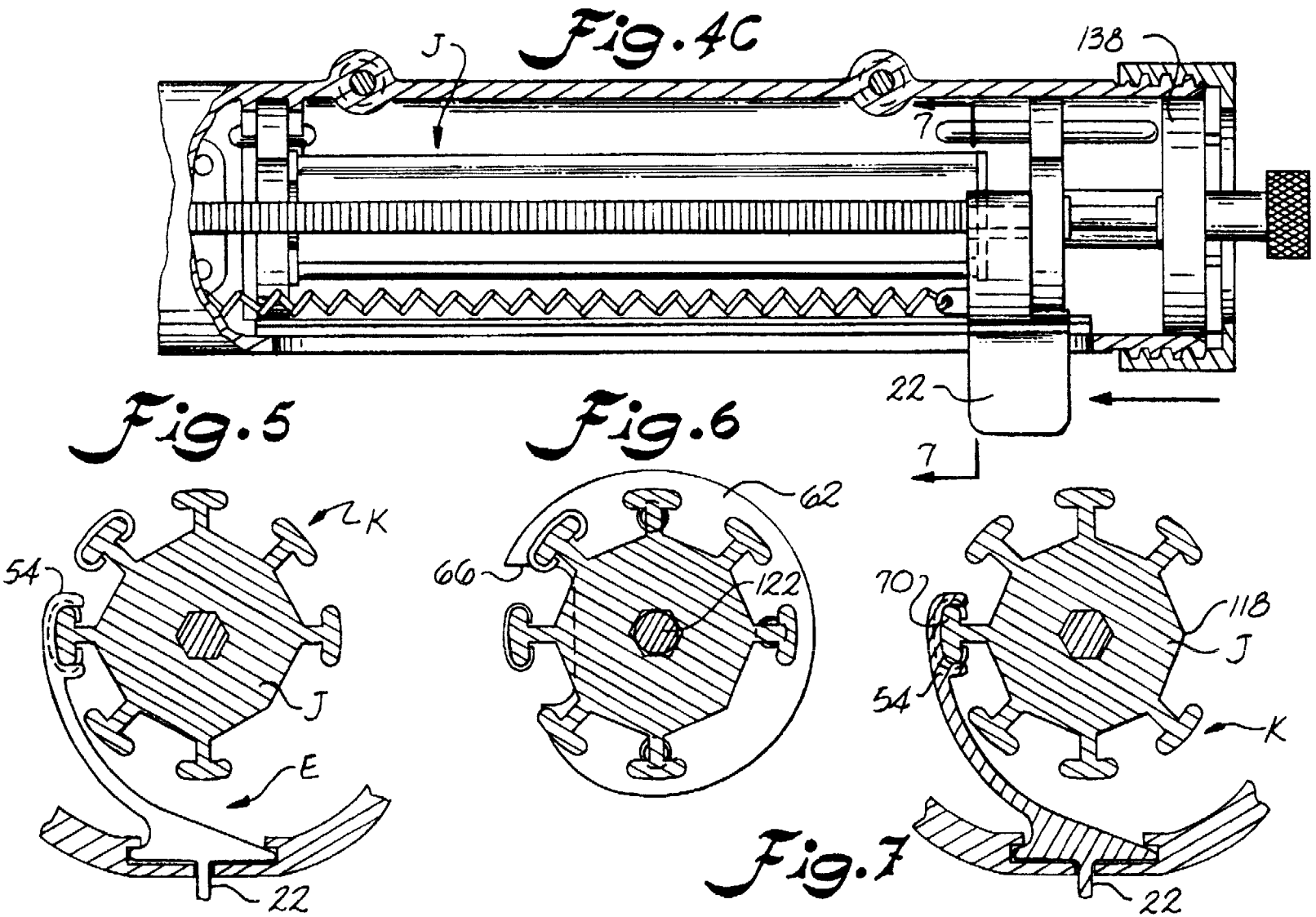
FIG. 4C is a partial sectional view of a traveler applicator device constructed in accordance with the present invention, illustrating a traveler pusher in a second rearward position after a traveler cartridge has been rotated to a new position.
FIG. 5 is a sectional view taken along lines 5—5 of FIG. 3.
FIG. 6 is a sectional view taken along lines 6—6 of FIG. 4B.
FIG. 7 is a sectional view taken along lines 7—7 of FIG. 4C.

While pusher E is in the rightmost position within slot 20, it is held between the right end of cartridge J and retainer 72 through engagement of head 54, to allow cartridge J to be indexed from the position shown in FIG. 4A to the position shown in FIG. 4B.

The terminus F of transport rail D is approximately at a right angle with respect to the portion of the transport rail D onto which the travelers are initially loaded. The travelers pass around a curved portion 74 on the transport rail D. This allows for proper presentation and orientation of a traveler when it is subsequently picked up by tooth G and advanced forward by traveler assembly H. Transport rail D is undercut at terminus F to allow the open side of a C-shaped traveler to clear transport rail D, thereby allowing the traveler to be removed by the rectilinear movement of tooth G.

Tooth G is perhaps best illustrated in FIG. 11 and FIGS. 14A through 14G. Tooth G is attached adjacent to the nose portion of linkage member 76 of transfer assembly H. Linkage member 76 is carried for sliding movement with respect to stationary member 78 and is connected for pivotal movement via pin 80 to a second linkage member 82, which in turn is connected for pivotal movement by a pin 84 to a third linkage member 86. Third link member 86 is fixedly attached to trigger B and moves corresponding to movement to trigger B about pin 88. A torsion spring 89 encircles pin 88, and is connected to trigger B to urge trigger B to its released position.

Figure 16A:
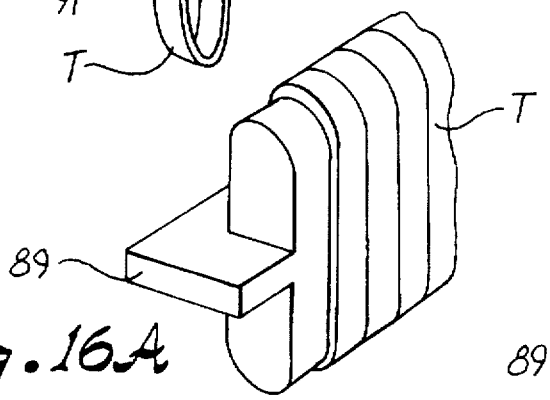
FIG. 16A is a partial perspective view of the free end of the transfer rail, without a traveler thereon.
Figure 16B:
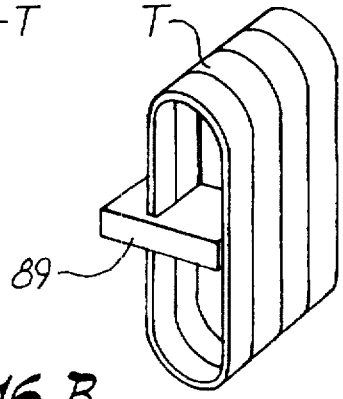
FIG. 16B is a partial perspective view of the end of the transfer rail, having plurality of travelers thereon.

Turning to FIG. 8, trigger B is shown in its released position. In this position, linkage, or transport, member 76 is in a retracted position, as is also tooth G. Upon squeezing of trigger B towards handle portion 14, linkage member 86 moves forward, causing a corresponding movement of linkage member 82, and, in turn, a corresponding forward advancement of transport member 76. This causes tooth G to pull the leading traveler outwardly from rail tongue 89, illustrated in FIGS. 16A and 16B, of terminus F of transport rail D and to move it linearly forward with the advancement of transport member 76. Rail tongue 89 is undercut such that a traveler T can be moved laterally thereon for stripping a traveler T from transport rail D. The undercut shape of rail tongue 89 thus allows tooth G to advance a traveler outwardly from transport rail D as tooth G moves forward. This traveler T is secured to tooth G by a spring clip 90 within a recess 91, illustrated more clearly in FIGS. 14A and 14B. Shearing edge 95, which serves to define recess 91, acts in cooperation with tooth G to shear the endmost traveler from rail tongue 89 as tooth G advances. Recess 91 acts as a traveler compartment for receiving a traveler sheared from transport rail D, and, through contact of spring clip 90, traveler T is retained in recess 91 as transport member 76 advances. Further depression of trigger B causes transport member to move to its furthermost outward, or extended, position, such as illustrated in FIG. 9, where the traveler can be snapped onto the ridge 92 of a ring R. A tongue 93 is connected to receiver 30 to aid in retaining a traveler on tooth G as tooth G moves to its extended position, carrying the traveler.

Figure 11:
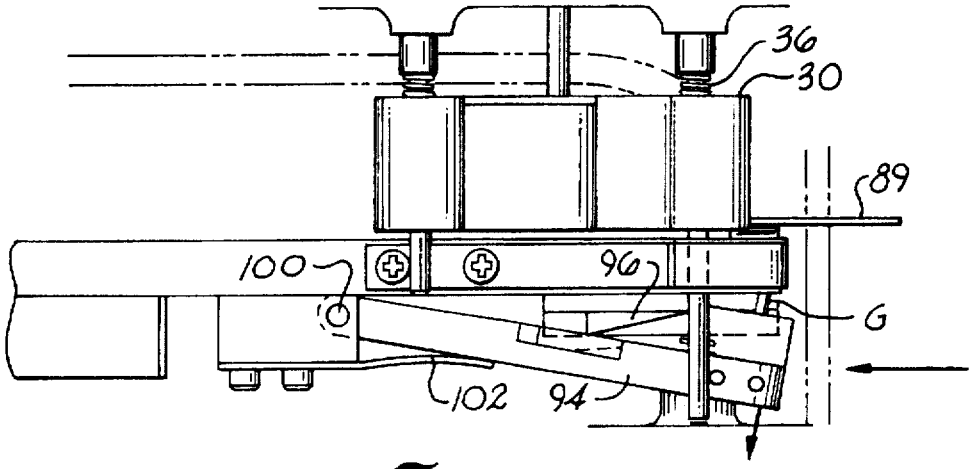
FIG. 11 is a partial plan view of the traveler applicator device constructed in accordance with the present invention, illustrating a traveler tooth in a clearance position.
Figure 14F:
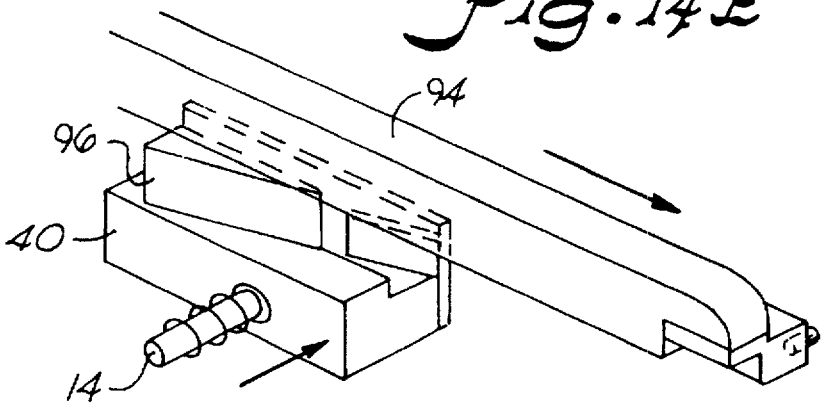
FIG. 14F is a partial perspective view of the transfer assembly shown in FIG. 14C, illustrating the traveler block assembly in an engagement position and the transfer assembly in an extended position.
Figure 14G:
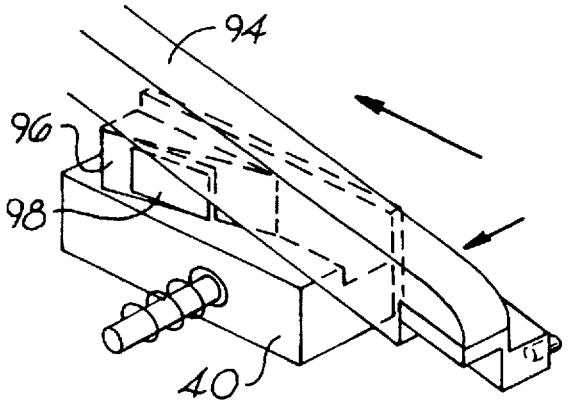
FIG. 14G illustrates a partial perspective view of the transfer assembly shown in FIG. 14C, illustrating a traveler tooth in a clearance position.
Figure 15A:
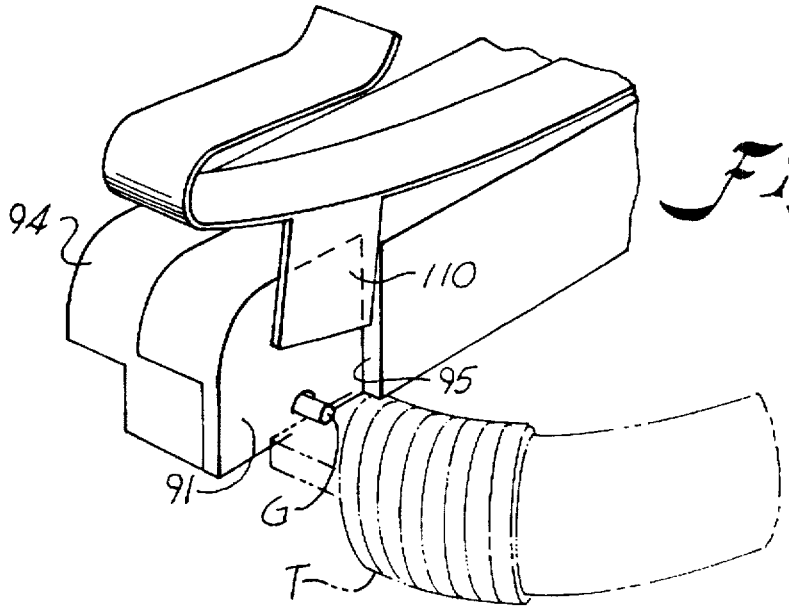
FIG. 15A is a partial perspective view of the transfer assembly illustrated in FIGS. 14A and 14B, illustrating a traveler receiving compartment prior to receipt of a traveler.
Figure 15B:
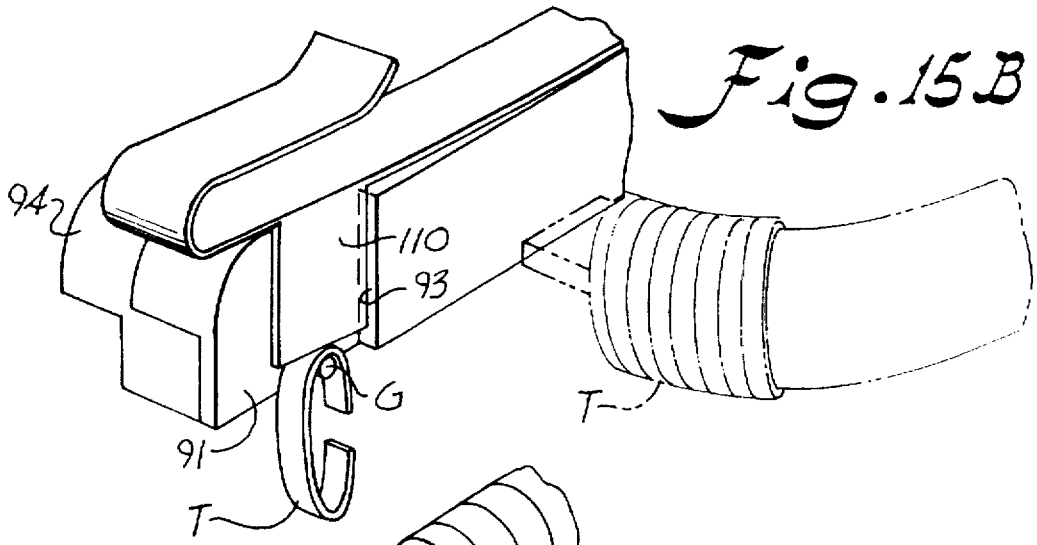
FIG. 15B is a partial perspective view of the transfer assembly illustrated in FIG. 15A, illustrating a traveler within the traveler receiving compartment.

Upon release of trigger B, transport member 76 moves rearwardly as illustrated in FIG. 14G. As transport member 76 moves rearwardly, a pivoting member 94, to which tooth G is attached, engages with a first wedge member 96 to pivot member 94 outwardly away from transport member 76, and to also, correspondingly, move tooth G outwardly away from terminus F of transport rail D to a clearance position. This allows tooth G to "step over" the closed back portion of the traveler waiting at terminus F. As the transport member 76 continues to move rearwardly, upon release of trigger B, a downwardly extending wedge flange 98 of pivotal member 94 clears wedge 96, and pivotal member 94 moves from its clearance position, illustrated in FIG. 14G, to its engagement position, such as illustrated in FIG. 14F. Pivoting member 94 is connected to transport number 76 by means of a pin 100. A leaf spring member 102 is attached to a block 104 through which pin 100 passes, and leaf spring 102 contacts the face of pivoting member 94 to continually urge pivoting member 94 towards its engagement position. FIG. 11 illustrates pivoting member 94 moving towards its clearance position, wherein tooth G clears the next traveler at terminus F prior to snapping back in place in the central opening of that traveler. FIG. 12 illustrates tooth G in its engagement position engaging with the next traveler at terminus F.

As transport member 76 retracts, a curved portion 106 of spring 90 engages with a bar 108, which causes a lifting of spring member 90. This allows tooth G to securely seat within the central opening of the next traveler waiting at terminus F. Upon forward advancement of transport member 76, the curved portion 106 of spring 90 disengages with bar 108, which causes spring member 90 to move downwardly such that a flange portion 110 of spring member 90 engages the top portion of the traveler pulled out by tooth G as transport number 70 advances, as shown in FIG. 14B.

Traveler block assembly I works in conjunction with transport assembly H to help prevent the next traveler from leaving terminus F until that traveler is actually physically transported by tooth G. As illustrated in FIGS. 14C through 14G, as transport member 76 advances, traveler block 40 is moved outwardly through interaction of wedge flange 98 carried on the underside of transport member 76, acting in conjunction with the backside of wedge 40 carried upon traveler block 40. This causes the traveler block 40 to release the next traveler such that tooth G can extract the traveler and carry it forward. Once tooth G has moved a sufficient distance in carrying the next traveler away from terminus F, traveler block 40 snaps back into place for blocking the next traveler from further movement at terminus F. A traveler plate 112, connected to traveler block 40 makes actual contact the next traveler for blocking it from further movement. Traveler block 40 is slidable on shaft 114, but is urged towards its blocking position by a coil spring 116 carried on shaft 114.

Cartridge J includes a plurality of cartridge rails K provided thereon. Although seven cartridge rails K are illustrated in the drawings, it is to be understood that more or less rails K could be provided on cartridge J, depending on the particular travelers loaded on cartridge J the size of such travelers, the shape of such travelers, etc. Cartridge J, in the preferred embodiment, includes a portion 118 on its periphery where no rail K is provided. This allows for pusher head 54 of pusher E to be moved to it rearwardmost position, such as shown in FIG. 4B, without engaging a rail K after a cartridge J has been loaded into compartment C. Cartridge J would then be indexed such that the rightmost end of the next rail would be engagable by pusher E, as illustrated in FIG. 4C. Cartridge J is provided with rails of a cross-sectional shape which allow for the same cartridge to be used for a variety of different types of travelers. Cartridge J can be reusable, or, could be made relatively inexpensively so that it could be discarded after its traveler supply was exhausted. Cartridge J includes washer 62 provided thereon. Washer 62 is, as discussed above, rotatable with respect to cartridge J such that cartridge J can be indexed once carried in compartment C, while washer 62 remains stationary.

Cartridge indexing mechanism L includes an elongated shaft 120 having a tip portion 122 which is inserted through a longitudinal bore 124 provided in cartridge J. A spring 126 is provided on shaft 120 to bear against end 56 of cartridge J when shaft 120 is inserted through bore 124 of cartridge J. Preferably, both shaft 120 and bore 124 of cartridge J have cooperating cross-sectional profiles, such as the hexagonal profile illustrated in FIGS. 5 through 7. This allows shaft 120 to be rotated by knob 58 for causing corresponding rotation of cartridge J. Coil spring 126 on shaft 120 urges cartridge J towards transport rail D once cartridge J has been inserted through the rear opening 128 of handle member A.

Retainer member 72 is also provided on shaft 120 and includes a slot for allowing pusher head 54 of pusher E to slide into the interface between cartridge end 56 and retainer 72 when pusher head E is moved to its rightmost position, as illustrated in FIG. 4B. A notch 134 is provided in retainer number 72 for engaging with a raised rib 136 provided in portion 14 of handle A to properly align retainer member 72 with respect to cartridge J. A cap member 138 is provided on shaft 120 and is spaced from retainer 72 by a spacer member 140. Cap member 138 substantially closes off open end 128 of handle member A and is held in place by a threaded ring 142, which is threadingly connected to the threads 144 provided on the end 23 of handle member A.

Although not illustrated, instead of having longitudinally-extending rails K, cartridge J could include, although not shown, rails of other configurations. For example, rails could extend circumferentially or helically about cartridge J or could extend about cartridge J in some other curvilinear fashion. Additionally, although not shown, one single rail could be provided which would extend helically about the periphery of cartridge J in a manner similar to the thread on a screw. A longitudinally moveable member (not shown) could thus be provided which would be biased by a spring member or members (not shown) or biased in some other fashion to continually press on the group of travelers carried on such a helical rails or plurality thereof, for advancing such travelers towards the transport rail D.

Another feature of traveler applicator 10 is that it can be used for various sizes of travelers. In order to adjust the proper clearance between transfer assembly H, retaining block assembly I, tooth G and receiver 30, a threaded knob 146 is provided for threadingly engaging a shaft 148, as illustrated in FIG. 13, and a well 150 is provided for receipt of a particular traveler T of the style to be loaded in applicator 10. By tightening knob 146 against the traveler T, proper spacing, as indicated by arrows 147, of assemblies H and I and tooth G with respect to receiver 30 can be achieved for travelers of that particular type.

When inserting a cartridge of travelers into applicator 10, ring 142 is unscrewed, and the cartridge indexing mechanism L is removed. The new cartridge J is inserted into compartment C, and shaft 120 is inserted into cartridge bore 124, until the tip 122 of shaft 120 is received in a bore 152 in member 52. Cartridge J is rotated with knob 58 until pusher head 54 can pass down the open portion 118 of cartridge J. Once pusher E is at its rearwardmost position, cartridge J can be rotated such that a cartridge rail K full of travelers is in alignment with free end 42 of transport rail D. Pusher E can then be released such that pusher head 54 engages the rightmost traveler, as illustrated in FIG. 4C, on rail K to urge all the travelers on rail K and all of the travelers on transport rail D, toward terminus F of transport rail D.

As travelers are dispensed onto rings through actuation of trigger B, the cartridge J remains stationary. However, upon depletion of a rail of the cartridge, pusher E is moved to the position illustrated in FIG. 4B, and cartridge J is rotated such that a rail full of travelers is presented to pusher E. Then, pusher E is again allowed to push travelers from this new rail. Once all the rails of cartridge J are depleted of travelers, removal of cartridge J is accomplished in reverse order as it was installed, as discussed above.

In a preferred embodiment, portions 12, 14 of handle A are constructed of injected-molded plastic. It is to be understood, however, that other materials could be used instead, such as metal, wood, or the like. Also, various materials could be used to construct other portions of applicator 10 such as metal, plastic, etc.

From the foregoing it can be seen that traveler applicator 10 provides a handy traveler application device, and that the traveler cartridges J of the present invention allow for quick and easy replenishment of travelers to the applicator.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A device for applying a traveler to a ring of a textile fiber processing machine, the device comprising:

a body member;

a traveler rail connected to said body member adapted for carrying a plurality of travelers for sliding movement thereon, said traveler rail having a free end for dispensing travelers; and a tooth carried by said body member and movable between a retracted position adjacent said free end of said traveler rail and an extended position extending beyond said free end of said traveler rail; said tooth being adapted to engage a traveler on said traveler rail when in said retracted position; said tooth being further adapted to remove the traveler from said free end of said traveler rail and to hold the traveler and transport the traveler away from said free end of said traveler rail as said tooth moves from said retracted position to said extended position, whereby the traveler becomes attachable to the ring of the textile fiber processing machine while held by said tooth in said extended position.

2. A device as defined in claim 1, wherein said body member includes a first end and a second end opposite said first end, and wherein said body member defines a traveler receiving compartment; said traveler receiving compartment being open to said first and second ends of said body member; and, wherein said traveler rail is substantially disposed within said traveler receiving compartment.

3. A device as defined in claim 1, further comprising a cartridge associated with said traveler rail, said cartridge having at least one cartridge rail thereon, said cartridge rail being adapted for carrying a plurality of travelers thereon.

4. A device as defined in claim 1, wherein said body member has a first end and a second end opposite said first end, and wherein said body member defines a traveler receiving compartment; said traveler receiving compartment being open to said first and second ends of said body member; and a cartridge carried in said traveler receiving compartment, said cartridge defining a longitudinal axis and being carried for rotation about said longitudinal axis within said traveler receiving compartment; said cartridge having a plurality of cartridge rails, each of said plurality of cartridge rails being adapted for carrying a plurality of travelers thereon.

5. A device as defined in claim 4, further comprising a pusher carried for movement adjacent to at least one of said cartridge rails for pushing a traveler from said cartridge rail to said traveler rail.

6. A device as defined in claim 4, further comprising a cartridge indexer connected to said cartridge and adapted for rotating said cartridge about said longitudinal axis and for aligning one of said plurality of cartridge rails with said traveler rail for allowing travelers to pass from said cartridge rail to said traveler rail.

7. A device as defined in claim 1, further comprising a trigger associated with said tooth, said trigger being moveable between an actuated position and a released position, and said trigger and said tooth being adapted such that when said trigger is moved to said actuated position, said tooth moves to said extended position.

8. A device as defined in claim 1, wherein said tooth is moveable between clearance position and an engagement position, and further comprising a tooth clearance member associated with said tooth and adapted for causing said tooth to move from said engagement position to said clearance position as said tooth moves from said extended position towards said retracted position.

9. A device as defined in claim 1, further comprising an adjuster member carried by said body member for adjusting the distance between said tooth and said traveler rail.

10. A device as defined in claim 1, further comprising a traveler stop member associated with said traveler rail, said traveler stop member moveable between an advanced position and a retracted position; said traveler stop being adapted for blocking movement of a traveler on said traveler rail when said traveler stop member is in said advanced position and for allowing movement of a traveler on said traveler rail when said traveler stop member is in said retracted position.

11. A device as defined in claim 10, further comprising an adjuster member carried by said body member for adjusting the distance between said traveler stop member and said traveler rail.

12. A device as defined in claim 1, further comprising a traveler engagement member carried with said tooth for contacting and urging a traveler against said tooth as said tooth moves from said retracted position to said extended position.

13. A device as defined in claim 1, further comprising a pusher member associate with said traveler rail for pushing a traveler along said traveler rail towards said tooth.

14. A device as defined in claim 1, further comprising a shearing portion carried near said tooth for engaging a traveler and moving the traveler from said traveler rail as said tooth moves between said retracted position and said extended position.

15. A device as defined in claim 1, further comprising a transport member carrying said tooth and said transport member defining a recess adjacent said tooth for receiving a traveler removed from said traveler rail.

16. A device as defined in claim 15, further comprising said transport member having a shearing portion adjacent said recess for engaging and moving a traveler as said tooth moves between said retracted position and said extended position.

17. A device for applying a traveler to a ring of a textile fiber processing machine, the device comprising:

a body member;

a traveler rail connected to said body member adapted for carrying a plurality of travelers for sliding movement thereon, said traveler rail having a free end for dispensing travelers;

a tooth carried by said body member moveable between a retracted position adjacent said free end of said traveler rail and an extended position extending beyond said free end of said traveler rail;

transfer means associated with said tooth for moving said tooth between said engagement position and said extended position; and said tooth being adapted to engage a traveler on said traveler rail when in said retracted position, and said tooth being adapted to remove the traveler from said free end of said traveler rail and to hold the traveler and transport the traveler away from said free end of said traveler rail as said tooth moves from said retracted position to said extended position, whereby the traveler becomes attachable on a ring of the textile fiber processing machine while held by said tooth in said extended position.

18. A device as defined in claim 17, further comprising traveler storage means associated with said traveler rail for carrying a plurality of travelers thereon for subsequent transfer to said traveler rail.

19. A device as defined in claim 18, further comprising a dispensing means associated with said traveler storage means for dispensing a traveler from said traveler storage means to said traveler rail.

20. A device as defined in claim 18, wherein said traveler storage means includes a cartridge having a plurality of cartridge rails thereon, each of said plurality of cartridge rails being adapted for carrying a plurality of travelers thereon; and further comprising indexing means associated with said cartridge for moving said cartridge to align one of said plurality of cartridge rails with said traveler rail for allowing travelers to pass from said cartridge rail to said traveler rail.

21. A device as defined in claim 18, wherein said traveler storage means includes a cartridge having a plurality of cartridge rails thereon, each of said plurality of cartridge rails being adapted for carrying a plurality of travelers thereon; and further comprising an indexing member associated with said cartridge for rotating said cartridge to align one of said plurality of cartridge rails with said traveler rail for allowing travelers to pass from said cartridge rail to said traveler rail.

22. A device as defined in claim 17, wherein said tooth is moveable between a clearance position and an engagement position, and further comprising clearance means associated with said tooth for causing said tooth to move from said engagement position to said clearance position as said tooth moves from said extended position towards said retracted position.

23. A device as defined in claim 22, further comprising actuation means associated with said clearance means and said tooth for causing said tooth to move between said retracted and said extended means.

24. A device as defined in claim 17, further comprising traveler stop means associated with said traveler rail for allowing movement of a traveler on said traveler rail as said tooth moves from said retracted position towards said extended position and for blocking movement of a traveler on said traveler rail as said tooth moves from said extended position to said retracted position.

25. A device as defined in claim 17, wherein said body member has a first end a second end opposite said first end, and wherein said body member defines a traveler receiving compartment; said traveler receiving compartment being open to said first and second ends of said body member; and traveler storage means associated with said traveler rail for carrying a plurality of traveler thereon for subsequent transfer to said traveler rail.

26. A device as defined in claim 17, further comprising actuation means associated with said tooth for causing said tooth to move between said retracted and said extended means.

27. A device as defined in claim 17, further comprising a shearing portion carried near said tooth for engaging a traveler and moving the traveler from said traveler rail as said tooth moves between said retracted position and said extended position.

28. A device as defined in claim 17, further comprising a transport member carrying said tooth and said transport member defining a recess adjacent to said tooth for receiving a traveler removed from said traveler rail.

29. A device as defined in claim 28, further comprising said transport member having a shearing portion adjacent to said recess for moving the traveler as said tooth moves between said retracted position and said extended position.

30. A device for holding and dispensing travelers in a traveler applicator apparatus having a traveler rail with a free end for dispensing travelers, the traveler dispensing apparatus having a tooth for removing a traveler from the free end of the traveler rail and for holding and transporting the traveler away from the free end of the traveler rail to allow attachment of the traveler to a spinning ring while the traveler is held by the tooth, the device comprising:

a traveler holding member having at least one rail, said rail being adapted for slidingly carrying a plurality of travelers thereon and for dispensing the travelers to the traveler rail of the traveler applicator apparatus.

31. A device as defined in claim 30, wherein said traveler holding member includes an elongated cartridge defining a longitudinal axis and wherein said at least one rail includes a plurality of rails extending longitudinally about said elongated cartridge.

32. A device as defined in claim 31, further comprising a cartridge indexer connected to said elongated cartridge and adapted for rotating said elongated cartridge about said longitudinal axis to align one of said plurality of rails with said traveler rail for allowing travelers to pass from said one of said plurality of rails to said traveler rail.

33. A device as defined in claim 30, wherein said at least one rail is a plurality of rails.

34. A device as defined in claim 30, further comprising a travelers retainer associated with said traveler holding member for allowing traveler to be removed from only one of said plurality of rails at a time.

35. A device for holding and dispensing travelers in a traveler applicator apparatus having a traveler rail, the device comprising:

a traveler holder having a first end and a plurality of longitudinally extending rails, each of said plurality of rails being adapted for slidingly carrying a plurality of travelers thereon and for dispensing the travelers to the traveler rail of the traveler applicator apparatus; and a traveler retainer rotatably carried on said first end of said traveler holder for allowing travelers to be removed from only one of said plurality of rails at a time.

36. A device as defined in claim 35, wherein said traveler holder includes a generally cylindrical cartridge having said plurality of longitudinally extending rails thereon.

37. A device for applying a traveler to a ring of a textile fiber processing machine, the device comprising:

a body member, said body member having a first end and a second end opposite said first end, said body member defining a traveler receiving compartment, said traveler receiving compartment being open to said first and second ends of said body member;

a cartridge carried in said traveler receiving compartment, said cartridge defining a longitudinal axis and being rotatable about said longitudinal axis within said traveler receiving compartment; said cartridge having a plurality of cartridge rails, each of said plurality of cartridge rails being adapted for carrying plurality of travelers thereon;

a transport rail having a first end next to at least one of said cartridge rails and a second end next to said second end of said traveler receiving compartment;

a spring-biased pusher carried for movement adjacent at least one of said cartridge rails for pushing a traveler from said cartridge rail towards said transport rail; and a tooth connected to said body member, said tooth being movable between a retracted position adjacent said second end of said transport rail and an extended position extending beyond said second end of said traveler rail, said tooth being adapted to remove a traveler on said second end of said transport rail when in said retracted position and to hold the traveler for placement of a traveler on a ring of the textile fiber processing machine when in said extended position and while held by said tooth.

38. A method of providing travelers in a traveler dispensing apparatus, the method comprising:

providing a traveler holder having a first end and having a plurality of longitudinally extending rails, each of said plurality of rails being adapted for slidingly carrying a plurality of travelers thereon and for dispensing the travelers to a traveler rail of the traveler dispensing apparatus;

providing a traveler retainer carried on said first end of said traveler holder for rotation relative to said traveler holder for allowing travelers to be removed from only one of said plurality of rails at a time; and dispensing travelers one at a time from one of said longitudinally extending rails of said traveler holder through an opening defined by said traveler retainer into the traveler dispensing apparatus.

39. The method as defined in claim 38, further comprising indexing said traveler holder to sequentially present each of said plurality of rails of travelers to the traveler dispensing apparatus one rail at a time.

40. A method of applying a traveler to a ring of a fiber processing machine, the method comprising:

providing a traveler applicator having a transport rail for carrying a plurality of travelers and a cartridge adjacent to said transport rail, said cartridge having a plurality of rails each carrying a plurality of travelers;

transferring a traveler from at least one of said rails of said cartridge to said transport rail;

moving the traveler transferred to said transport rail to the end of said transport rail;

providing a moveable tooth for engaging the traveler at said end of said transport rail;

removing the traveler from said end of said transport rail with said moveable tooth;

simultaneously holding and transporting said traveler outwardly from said end of said transport rail with said moveable tooth; and applying the traveler from said moveable tooth onto the ring of the fiber processing machine while the traveler is held by said tooth.

* * * * *